US010822560B2

(12) United States Patent
Kurkela et al.

(10) Patent No.: US 10,822,560 B2
(45) Date of Patent: Nov. 3, 2020

(54) METHOD AND APPARATUS FOR GASIFYING RAW MATERIAL AND GASEOUS PRODUCT

(71) Applicant: TEKNOLOGIAN TUTKIMUSKESKUS VTT OY, Espoo (FI)

(72) Inventors: Esa Kurkela, Vtt (FI); Ilkka Hiltunen, Vtt (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 0 days.

(21) Appl. No.: 15/525,543

(22) PCT Filed: Oct. 16, 2015

(86) PCT No.: PCT/FI2015/050702
§ 371 (c)(1),
(2) Date: May 9, 2017

(87) PCT Pub. No.: WO2016/075362
PCT Pub. Date: May 19, 2016

(65) Prior Publication Data

US 2017/0313951 A1 Nov. 2, 2017

(30) Foreign Application Priority Data

Nov. 14, 2014 (FI) ..... 20146000

(51) Int. Cl.
*C10J 3/66* (2006.01)
*C10J 3/42* (2006.01)
(Continued)

(52) U.S. Cl.
CPC . *C10J 3/66* (2013.01); *C10J 3/26* (2013.01); *C10J 3/42* (2013.01); *C10J 3/82* (2013.01);
(Continued)

(58) Field of Classification Search
CPC ..... C10J 3/26
See application file for complete search history.

(56) References Cited

U.S. PATENT DOCUMENTS 4,608,059 A 8/1986 Kupfer et al.
8,721,748 B1 * 5/2014 Potgieter ..... B01J 6/008 48/61

(Continued)

FOREIGN PATENT DOCUMENTS

CN 102424359 4/2012
CN 103555373 2/2014

(Continued)

OTHER PUBLICATIONS

Machine Translation of CN102424359 Downloaded Aug. 11, 2018 pp. 1-10 (Year: 2018).*

(Continued)

*Primary Examiner* — Douglas B Call
(74) *Attorney, Agent, or Firm* — Brooks Kushman P.C.

(57) ABSTRACT

A method and apparatus for gasifying raw material. The method includes feeding the raw material into an upper part of a fixed-bed gasifier, introducing the raw material from the upper part of the gasifier to a pyrolysis zone of the gasifier to form the fixed-bed and pyrolyzing the raw material in the presence of pyrolysis air to form a pyrolysis product. Introducing the pyrolysis product from the pyrolysis zone to a lower part of the gasifier, introducing primary air countercurrently to the lower part, carrying out a final gasification in a lower part of the gasifier in order to form a gasified gas. Introducing the gasified gas to a catalytic oxidation part and through a catalyst layer of the catalytic oxidation part, and reforming the gasified gas by way of the catalytic oxidation in the presence of reforming air in the catalytic oxidation part, forming a gaseous product.

5 Claims, 1 Drawing Sheet

(51) Int. Cl.
*C10J 3/26* (2006.01)
*C10J 3/82* (2006.01)

(52) U.S. Cl.
CPC ..... *C10J 2200/06* (2013.01); *C10J 2200/158* (2013.01); *C10J 2300/092* (2013.01); *C10J 2300/0916* (2013.01); *C10J 2300/0956* (2013.01); *C10J 2300/0986* (2013.01)

(56) References Cited

U.S. PATENT DOCUMENTS

| | | | |
|---|---|---|---|
| 9,090,465 | B2 | 7/2015 | Suzuki et al. |
| 2002/0095866 | A1 | 7/2002 | Hassett |
| 2006/0265954 | A1 | 11/2006 | Dogru et al. |
| 2010/0050515 | A1 | 3/2010 | Wakefield et al. |

FOREIGN PATENT DOCUMENTS

| | | | |
|---|---|---|---|
| JP | H02107694 | A | 4/1990 |
| JP | 2004131578 | A | 4/2004 |
| JP | 2006504922 | A | 2/2006 |
| JP | 2014515774 | A | 7/2014 |
| WO | 9426849 | | 11/1994 |
| WO | 2004/039924 | A1 | 5/2004 |
| WO | 2009020442 | | 2/2009 |
| WO | 2010035430 | A1 | 4/2010 |
| WO | 2012/138751 | A1 | 10/2012 |

OTHER PUBLICATIONS

International Search Report for PCT/FI2015/050702, Completed by the Finnish Patent and Registration Office dated Mar. 14, 2016, 4 Pages.
Finnish Search Report for Finnish Application No. FI 2014600, Completed by the Finnish Patent and Registration Office dated Jun. 9, 2015, 1 Page.
Extended European Search Report for European Application No. EP 15859831.8, dated Jun. 12, 2018, 8 Pages.
Machine translation of Abstract JPH02107694.
Machine translation of Abstract JP2004131578.

* cited by examiner

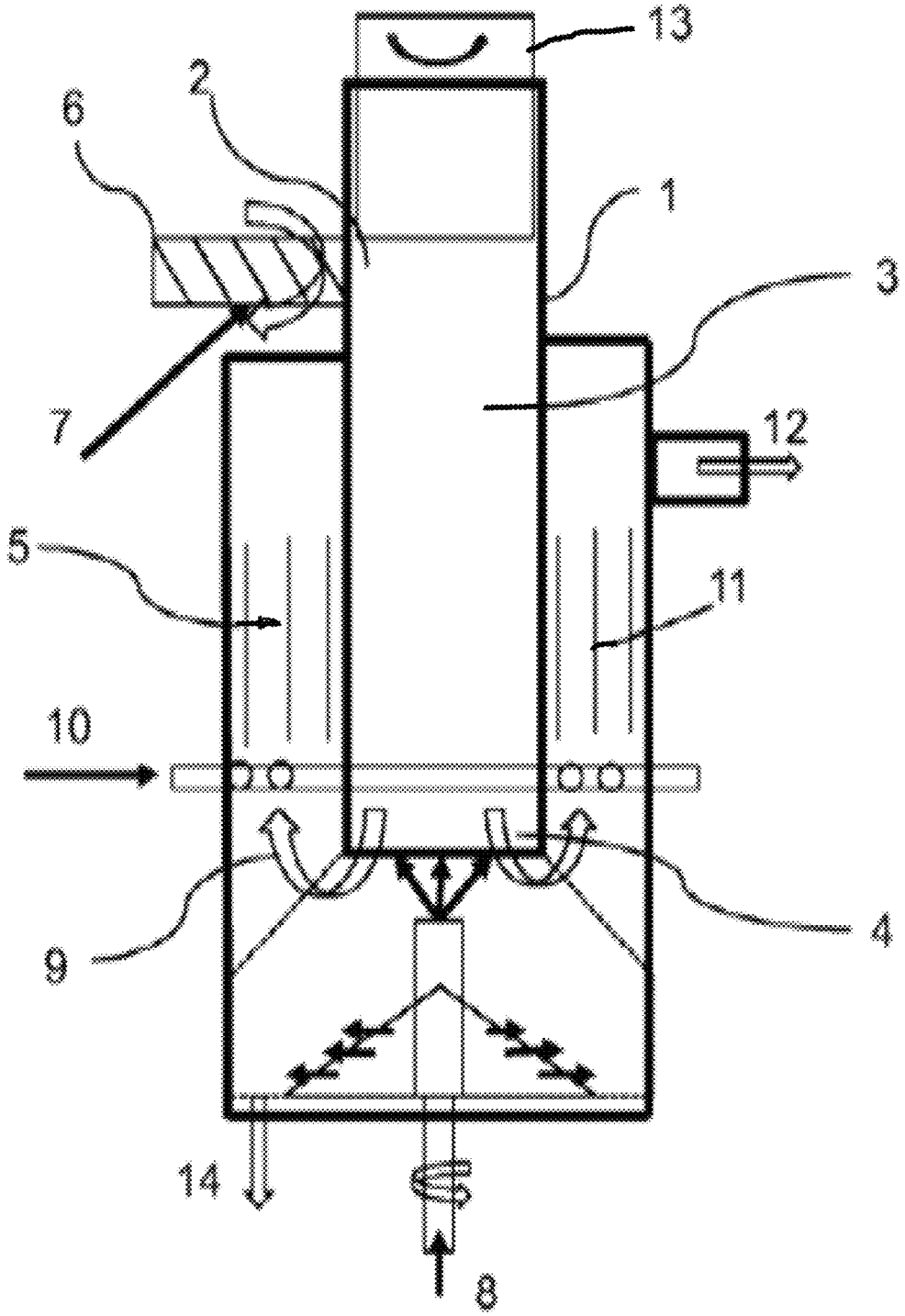
13
2
6
1
3
7
12
5
11
10
9
4
14
8

METHOD AND APPARATUS FOR GASIFYING RAW MATERIAL AND GASEOUS PRODUCT

CROSS-REFERENCE TO RELATED APPLICATION

This application is the U.S. national phase of PCT Application No. PCT/FI2015/050702 filed on Oct. 16, 2015, which claims priority to FI Patent Application No. 20146000 filed on Nov. 14, 2014, the disclosures of which are incorporated in their entirety by reference herein.

FIELD OF THE INVENTION

The invention relates to a method and an apparatus for gasifying raw material.

BACKGROUND OF THE INVENTION

Different pyrolysis and gasification methods and apparatuses are known from the prior art. The pyrolysis and gasifier products are produced from different raw materials, such as organic materials and biomass.

In several countries there is an increasing potential for small-scale biomass-to-power plants. Conventional combustion and steam cycle are inefficient and too expensive at below 5-10 MW fuel capacity.

Existing downdraft gasifiers require very high-quality wood fuels or biomass, such as ash-free wood blocks or high quality wood chips, and cannot be scaled up to economically attractive 0.5-2 MW scale without severely increased tar production. In addition, downdraft gasifiers have poor carbon conversion efficiency. The ideal operation requires good contact with oxygen and pyrolysis products. The ash usually contains rather much unburnt carbon, and the tar content is too high for engine use. The other basic gasifier type, such as updraft gasifier, has good carbon conversion but produces an abundance of tars which are very difficult to remove from the product gas without creating a massive waste water problem.

Objective of the Invention

The objective of the invention is to disclose a new type method and apparatus for gasifying raw material. Further, the objective of the invention is to disclose a method and apparatus for forming a new type product that is a low-tar gaseous product. Further, the objective of the invention is to produce a new low-tar product.

SUMMARY OF THE INVENTION

The method and apparatus according to the invention is characterized by what has been presented in the claims.

The invention is based on a method for gasifying raw material. According to the invention, the method comprising: feeding the raw material into an upper part of a fixed-bed gasifier; introducing the raw material from the upper part of the gasifier to a pyrolysis zone of the gasifier to form the fixed-bed in the pyrolysis zone and pyrolyzing the raw material in the presence of pyrolysis air in the pyrolysis zone to form a pyrolysis product which is preferably a pyrolysis gas product; introducing the pyrolysis product from the pyrolysis zone to a lower part of the gasifier; introducing primary air countercurrently to the lower part; carrying out a final gasification in a lower part of the gasifier in order to form a gasified gas; introducing the gasified gas to a catalytic oxidation part and through a catalyst layer of the catalytic oxidation part; and reforming the gasified gas by means of the catalytic oxidation in the presence of reforming air in the catalytic oxidation part; and then a gaseous product with low-tar content is formed. Preferably, the pyrolysis zone is a middle part of the gasifier. Preferably, also combustion of charcoal happens in the lower part of the gasifier.

Further, the invention is based on an apparatus for gasifying raw material. According to the invention, the apparatus comprises a fixed-bed gasifier which comprises an upper part, pyrolysis zone in a middle part of the gasifier and lower part, and catalytic oxidation part; at least one feeding device for feeding the raw material into the upper part of the fixed-bed gasifier from which the raw material is introduced to the pyrolysis zone to form the fixed-bed in the pyrolysis zone; the fixed-bed in the pyrolysis zone in which the raw material is pyrolyzed for forming a pyrolysis product which is introduced to the lower part; a first air feeding equipment for introducing pyrolysis air to the pyrolysis zone; a second air feeding equipment for introducing primary air countercurrently to the lower part; gas introducing equipment for introducing a gasified gas formed by a final gasification in the lower part to the catalytic oxidation part; a third air feeding equipment for introducing reforming air for the catalytic oxidation; and a catalyst layer in the catalytic oxidation part through which the gasified gas is led and in which the gasified gas is treated, preferably reformed, by means of the catalytic oxidation and in the presence of reforming air in order to form a low-tar gaseous product.

Further, the invention is based on a gaseous product. The gaseous product with low-tar content is formed by the method of the invention. In one embodiment, the main components of the gaseous product are carbon monoxide, hydrogen, carbon dioxide, methane, nitrogen and water vapour. In addition the gaseous product may contain small amounts of different gas impurities originating from the raw material. In one embodiment, the gaseous product contains less than 200 $mg/m^3n$ hydrocarbon components heavier than benzene.

Any reactor or gasifier which are suitable for gasifying and/or which are known per se can be used in the gasification. Preferably, the gasifier is fixed-bed reactor. In one embodiment, the gasifier is a combination of a downdraft gasifier and a updraft gasifier.

In this context, a pyrolysis means a thermochemical decomposition of organic material at elevated temperatures in the presence of oxygen. The pyrolysis means any pyrolysis, thermolysis, thermochemical decomposition of the raw material or their combinations wherein volatile compounds are removed from the raw material. In this context, a pyrolysis zone means an area of the gasifier in which the pyrolysis is carried out. Preferably, the pyrolysis zone comprises a devolatilization stage of the raw material.

In this context, pyrolysis air, primary air and reforming air mean any air feed which may contain oxygen, nitrogen, steam and carbon dioxide. In one embodiment, pyrolysis air, primary air and/or reforming air contain oxygen. In one embodiment, pyrolysis air, primary air and/or reforming air comprises typical atmospheric air composition. In one embodiment, pyrolysis air, primary air and/or reforming air comprises oxygen, oxygen based composition or mixtures of oxygen and steam. In one embodiment, pyrolysis air, primary air and/or reforming air comprise carbon dioxide or carbon dioxide based composition.

In one embodiment, the raw material is selected from the group consisting of wood containing material, biomass based material and organic material, such as equivalent volatile materials containing organic material, and their combinations. For example, the raw material may be chips, forest chips, bark, sawdust, straw, peat and coal and their combinations. The raw material may contain also other organic component. The raw material may be includes one or more material component. Preferably, the raw material is in a solid form.

In one embodiment, the fixed bed is pressed for compacting, preferably for pressing occasionally the bed from the top. In one embodiment, the apparatus comprises a mechanical bed pressing device, such as a bed tightening device, for pressing and tightening the bed. The mechanical bed pressing device may be screw, piston type device or any other suitable device. Bed channelling is avoided and the downward flow of the raw material is assisted by using the mechanical bed pressing.

In one embodiment, the fixed bed is agitated by a rotating grate, for example from the bottom of the gasifier. In one embodiment, the apparatus comprises a rotating grate for agitating the bed. In one embodiment, the rotating grate is arranged on the bottom of the gasifier for agitating the bed.

In the pyrolysis zone the pyrolysis is carried out inside raw material bed in the presence of air. In one embodiment, the pyrolysis air is introduced to the pyrolysis zone. In one embodiment, temperature is controlled in the pyrolysis zone by means of the feeding of the pyrolysis air. In one embodiment, the pyrolysis is carried out at temperature between 500-600° C. to form a pyrolysis product. In one embodiment, the pyrolysis zone of the gasifier acts as downdraft zone. The presence of oxygen in the pyrolysis zone results in selective oxidation of heavy tars and minimizes the formation of thermally stable aromatic compounds.

The pyrolysis is carried out in the presence of air. In one embodiment only small amount of air is introduced into the pyrolysis zone so that the gas temperature before the catalyst oxidation part is in the range 400-600° C. In a preferred embodiment the amount of pyrolysis air is 5-40%, preferably 10-20%, of total air feed comprising the pyrolysis air, primary air and reforming air.

In the countercurrent lower part of the gasification, a final gasification is carried out in which charcoal is gasified and/or ash is oxidated. Further, tars may be partly decomposed in the lower part. Preferably, the lower part of the gasifier acts as updraft gasifier. The primary air is fed countercurrently to the lower part of the gasifier. In one embodiment part of the primary air is fed through the central pipe which is arranged higher in the bed and closer to the outlet of the pyrolysis zone in order to improve tar decomposition. Preferably, bottom ash is removed from the lower part. Complete combustion of the residual carbon can be achieved in the lower part before the bottom ash removal.

In one embodiment, the catalytic oxidation part is arranged to surround the pyrolysis zone.

In the catalytic oxidation residue tars are oxidated and decomposed in the catalyst layer. In one embodiment, temperature of the catalyst layer is between 600 to 900° C., preferably 700 to 800° C. Preferably, the decomposition of the tars is based on combined effects of selective oxidation, reforming and thermal cracking.

In one embodiment, temperature of the gasified gas is between 400 to 600° C. before the catalytic oxidation part.

In one embodiment, the apparatus comprises at least one temperature adjustment device for adjusting temperature before the catalytic oxidation part.

In one embodiment, the apparatus comprises at least one temperature adjustment device for adjusting temperature in connection with the pyrolysis zone.

In one embodiment, the reforming air is introduced to the catalytic oxidation part. In one embodiment, the reforming air is introduced into the catalytic oxidation just before, preferably just below, the catalytic oxidation part so that the oxidation reactions take place on the catalyst surfaces. This results in very efficient tar reduction at relatively low operating temperatures in the range 600-900° C.

The catalyst layer may comprise any suitable catalyst. In one embodiment the catalyst is selected from the group consisting of zirkonium-based catalyst, noble metal based catalyst, nickel-based monoliths, calcium-based catalyst, other suitable catalyst and their combinations. The catalyst may be formed with different shapes. The catalyst layer may be organised with different reactor designs, preferably using monolith elements or spouted or fluidised-bed design.

It is important for the invention that tar can be reduced. It is important that the oxidative pyrolysis, countercurrent gasifier lower part and catalytic tar decomposition and oxidation are used.

In one embodiment, the gaseous product is filtered in order to remove solid fraction, e.g. in the gas cleaning step. In one embodiment, the apparatus comprises at least one filtration device. The gaseous product may be filtrated by any suitable method or device.

In one embodiment, the gaseous product is post-treated by a gas scrubbing. Preferably, tar and sulphur may be removed during the gas scrubbing. In one embodiment, the apparatus comprises at least one gas scrubbing device for post-treating. Any suitable gas scrubbing device may be used.

In one embodiment, the gaseous product is cooled so that temperature is between 100-400° C. after the catalytic oxidation without tar condensation problems typical to gasifiers of prior art. In one embodiment, the apparatus comprises at least one cooling device. The gaseous product may be cooled by any suitable method or device, e.g. by heat exchanger.

In one embodiment, the gaseous product is treated by filtration, gas scrubbing and cooling. Thanks to this combination tar-containing waste waters do not form.

In one embodiment, the gaseous product is used and utilized as a fuel of energy production process. In one embodiment, the gaseous product is used as a fuel as such or after the gas scrubbing.

In one embodiment, oxygen or mixtures of oxygen and steam or carbon dioxide are used instead of air in one or more air feeding steps of the process. In this embodiment the gaseous product with lower nitrogen content and higher heating value is produced.

The invention provides the advantage that the low tar concentration can be achieved in the gaseous product. Thanks to the invention, complete raw material conversion, especially carbon conversion, is achieved due to oxidative process. Further, by means of the invention gaseous fuel product can be produced for energy production process or chemical synthesis.

The method and apparatus of the invention offers a possibility to form low-tar product cost-effectively and energy-effectively. The present invention provides an industrially applicable, simple and affordable way of producing low-tar product. The method and apparatus of the present invention is easy and simple to realize as a production process.

BRIEF DESCRIPTION OF THE DRAWINGS

In the following section, the invention will be described with the aid of detailed exemplary embodiments, referring to the accompanying figure wherein FIG. 1 presents one embodiment of the apparatus according to the invention.

DETAILED DESCRIPTION OF THE INVENTION

FIGS. 1 presents the apparatuses according to the invention for gasifying raw material.

EXAMPLE 1

The apparatus of FIG. 1 comprises a fixed-bed gasifier (1) which comprises an upper part (2), pyrolysis zone (3) in a middle part of the gasifier and lower part (4). Further, the apparatus comprises a catalytic oxidation part (5). The catalytic oxidation part (5) is arranged to surround the pyrolysis zone (3). Further, the apparatus comprises a feeding device (6) for feeding the raw material into the upper part (2) of the fixed-bed gasifier from which the raw material is introduced to the pyrolysis zone (3) to form the fixed-bed in the pyrolysis zone. The fixed-bed is arranged in the pyrolysis zone in which the raw material is pyrolyzed in the presence of pyrolysis air (7) for forming a pyrolysis product. The pyrolysis product is introduced to the lower part (4). Further, the apparatus comprises a first air feeding equipment for introducing the pyrolysis air (7) to the pyrolysis zone (3), a second air feeding equipment for introducing primary air (8) to the lower part (4) countercurrently, and gas introducing equipment for introducing a gasified gas (9) formed by a final gasification in the lower part (4) to the catalytic oxidation part (5). Further, the apparatus comprises a third air feeding equipment for introducing reforming air (10) for the catalytic oxidation just before the catalytic oxidation part (5), and a catalyst layer (11) in the catalytic oxidation part (5) through which the gasified gas (9) is led and in which the gasified gas is reformed by means of the catalytic oxidation and in the presence of reforming air (10) in order to form a gaseous product (12) with low-tar content.

Further, the apparatus comprises a bed tightening device (13) which is piston type device for pressing and tightening the bed. A bottom ash (14) can be removed from the apparatus from the bottom of the apparatus.

The devices used in this invention are known per se, and therefore they are not described in any more detail in this context.

EXAMPLE 2

In this test, the catalytic oxidation and its efficiency were studied in laboratory scale. The wood gasification gas was introduced to the catalytic oxidation device in which the gasification gas was treated according to the invention. Compositions of the gasified gas before the catalytic oxidation and the gaseous product after the catalytic oxidation are represented in table 1.

TABLE 1

| | Gasified gas prior catalytic oxidation | Gaseous product after catalytic oxidation |
|---|---|---|
| Gas components | | |
| CO, vol-% | 19.3 | 12.3 |
| $CO_2$, vol-% | 7.8 | 13.6 |
| $H_2$, vol-% | 8 | 13.7 |
| $CH_4$, vol-% | 2.8 | 2.4 |
| $C_2$-$C_5$, vol-% | 2.5 | 1.5 |
| $H_2O$, vol-% | 23.7 | 17 |
| $N_2$, vol-% | 35.9 | 39.5 |
| Higher hydrocarbon content, mg/m$^3$n (dry gas) | | |
| benzene | 4690 | 2020 |
| tars < naphthalene | 2910 | 20 |
| naphthalene | 1080 | 50 |
| tars > naphthalene | 1065 | <10 |

It was observed that residue tars can be oxidated and decomposed during the catalytic oxidation.

The method and apparatus according to the invention are suitable in different embodiments for gasifying different kinds of raw material. The method and apparatus according to the invention are suitable in different embodiments for forming different kinds of low-tar products.

The invention is not limited merely to the examples referred to above; instead many variations are possible within the scope of the inventive idea defined by the claims.

The invention claimed is:

1. A method for gasifying raw material, wherein the raw material is fed to a gasifier, the raw material is treated in the gasifier having different zones and a gas from the gasifier is treated by way of a catalytic treatment, wherein the method comprises:

providing a fixed-bed gasifier which is vertically inclined having an upper part forming a feed end, a lower part forming an output end, and a pyrolysis zone between the upper and lower parts, feeding the raw material and pyrolysis air into upper part of a fixed-bed gasifier, pressing the raw material to compact the bed;

introducing the raw material and pyrolysis air from the upper part of the fixed-bed gasifier to the pyrolysis zone of the fixed-bed gasifier and pyrolyzing the raw material in the presence of the pyrolysis air in the pyrolysis zone to form pyrolysis products, agitating the fixed bed with a rotating grate, introducing the pyrolysis products from the pyrolysis zone to a lower part of the fixed-bed gasifier, beneath the pyrolysis zone, introducing primary air beneath the lower part of the fixed-bed gasifier upwardly countercurrently to the flow of pyrolysis products to carry out a final gasification in a gasifier to form a gasified gas pyrolysis product and ash, introducing reforming air into the gasified gas pyrolysis product before the catalytic oxidation zone, introducing the gasified gas pyrolysis product and reforming air into a catalytic oxidation zone and passing the gasified gas pyrolysis product and reforming air through a catalyst layer in the catalytic oxidation zone, and reforming the gasified gas pyrolysis product by way of catalytic oxidation in the presence of the reforming air in the catalytic oxidation zone, in order to form a final gaseous product.

2. The method according to claim 1, wherein the reforming air is introduced just before the catalytic oxidation zone.

3. The method according to, claim 1, wherein the raw material is selected from the group consisting of wood containing material, biomass based material, organic material and their combinations.

4. The method according to claim 1, wherein temperature of the catalyst layer is between 600 to 900° C.

5. The method according to claim 1, wherein temperature of the gasified gas pyrolysis product is between 400 to 600° C. before the catalytic oxidation part.

* * * * *